US008330666B2

(12) United States Patent
Tsou et al.

(10) Patent No.: US 8,330,666 B2
(45) Date of Patent: Dec. 11, 2012

(54) MULTIBAND ANTENNA

(75) Inventors: Tun-Yuan Tsou, Tu-Cheng (TW); Yi-Chieh Lee, Tu-Cheng (TW)

(73) Assignee: Chi Mei Communications Systems, Inc., Tu-Cheng, New Taipei (TW)

( * ) Notice: Subject to any disclaimer, the term of this patent is extended or adjusted under 35 U.S.C. 154(b) by 464 days.

(21) Appl. No.: 12/693,641

(22) Filed: Jan. 26, 2010

(65) Prior Publication Data

US 2010/0309067 A1 Dec. 9, 2010

(30) Foreign Application Priority Data

Jun. 8, 2009 (CN) ..... 2009 1 0303052

(51) Int. Cl.
*H01Q 21/00* (2006.01)

(52) U.S. Cl. ..... 343/726; 343/730

(58) Field of Classification Search ..... 343/726, 343/727, 728, 729, 730, 700 MS
See application file for complete search history.

(56) References Cited

U.S. PATENT DOCUMENTS

| | | | | |
|---|---|---|---|---|
| 7,109,936 | B2 * | 9/2006 | Mizoguchi et al. | 343/726 |
| 7,868,836 | B2 * | 1/2011 | Vendik et al. | 343/726 |
| 2004/0183739 | A1 * | 9/2004 | Bisiules et al. | 343/795 |
| 2008/0111757 | A1 * | 5/2008 | Bisiules et al. | 343/799 |
| 2008/0266191 | A1 * | 10/2008 | Hilgers | 343/726 |

FOREIGN PATENT DOCUMENTS

CN 1734836A A 2/2006

* cited by examiner

*Primary Examiner* — Hoanganh Le
(74) *Attorney, Agent, or Firm* — Altis Law Group, Inc.

(57) ABSTRACT

A multiband antenna includes a first radio unit closed loop and a second radio unit connected to the first radio unit and symmetrical structure. When the multiband antenna functions, the first radio unit functions as a balanced loop antenna, and the second radio unit functions as a dipole antenna.

18 Claims, 4 Drawing Sheets

MULTIBAND ANTENNA

BACKGROUND

1. Technical Field

The present disclosure relates to multiband antennas, and particularly to multiband antennas used in portable electronic devices.

2. Description of Related Art

Nowadays, portable electronic devices, such as mobile phones, personal digital assistants (PDA) and laptop computers, are widely used. Most of these portable electronic devices have antennas mounted therein for receiving/sending wireless signals. Commonly, a portable electronic device may receive/send wireless signals of different frequencies, which requires its antenna be a multiband antenna.

Generally, multiband antennas have complicated structures and are difficult to be miniaturized. Furthermore once miniaturized, multiband antennas are difficult to be precisely installed in portable electronic devices. Thus, communication quality of the portable electronic devices using the multiband antennas may be adversely affected.

Therefore, there is room for improvement within the art.

BRIEF DESCRIPTION OF THE DRAWINGS

Many aspects of the present multiband antenna can be better understood with reference to the following drawings. The components in the various drawings are not necessarily drawn to scale, the emphasis instead being placed upon clearly illustrating the principles of the present multiband antenna. Moreover, in the drawings, like reference numerals designate corresponding parts throughout the figures.

DETAILED DESCRIPTION

Figure 1:
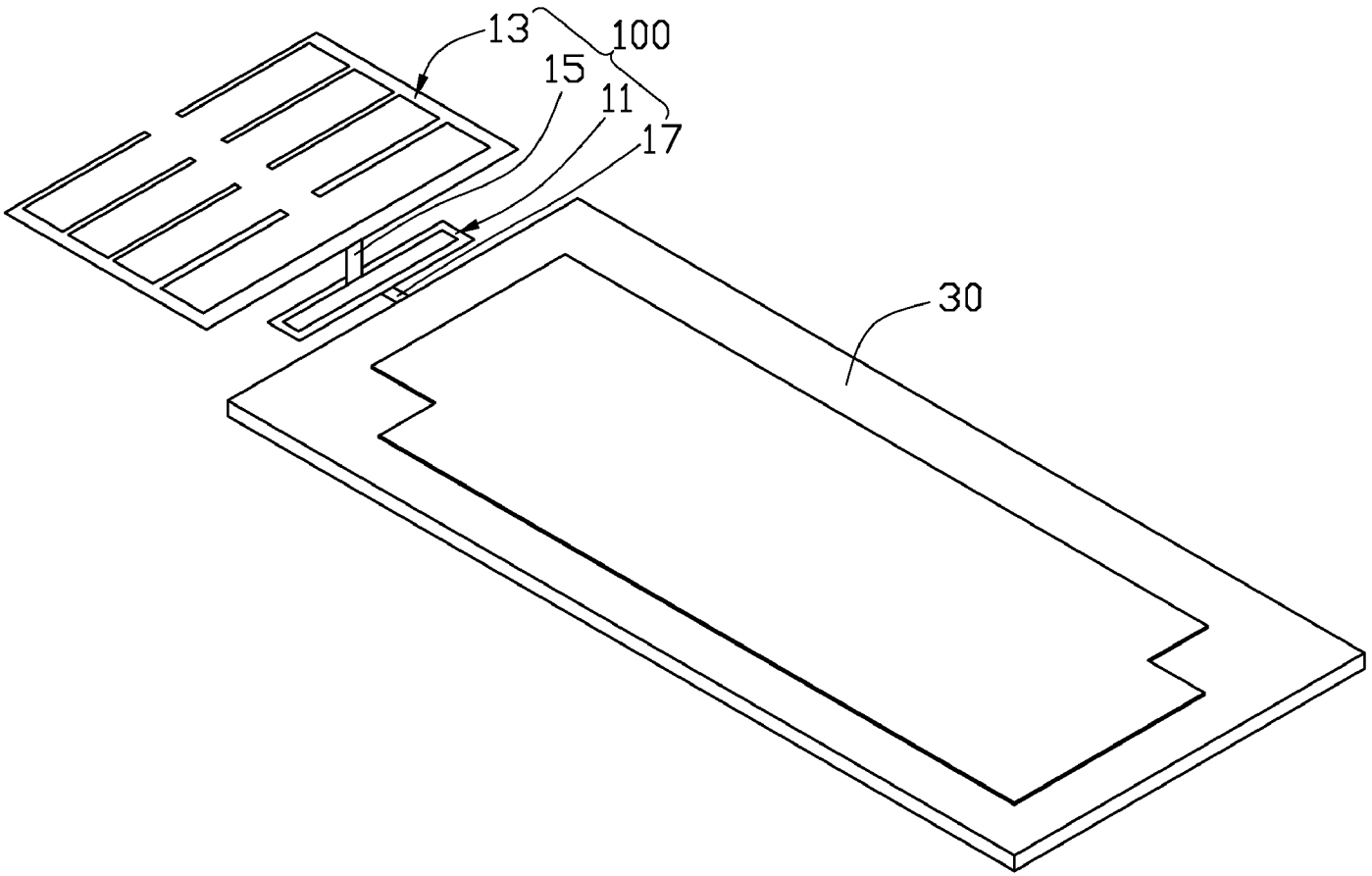
FIG. 1 is a schematic view of a multiband antenna, according to an exemplary embodiment, connected to a circuit board of a portable electronic device.
Figure 2:
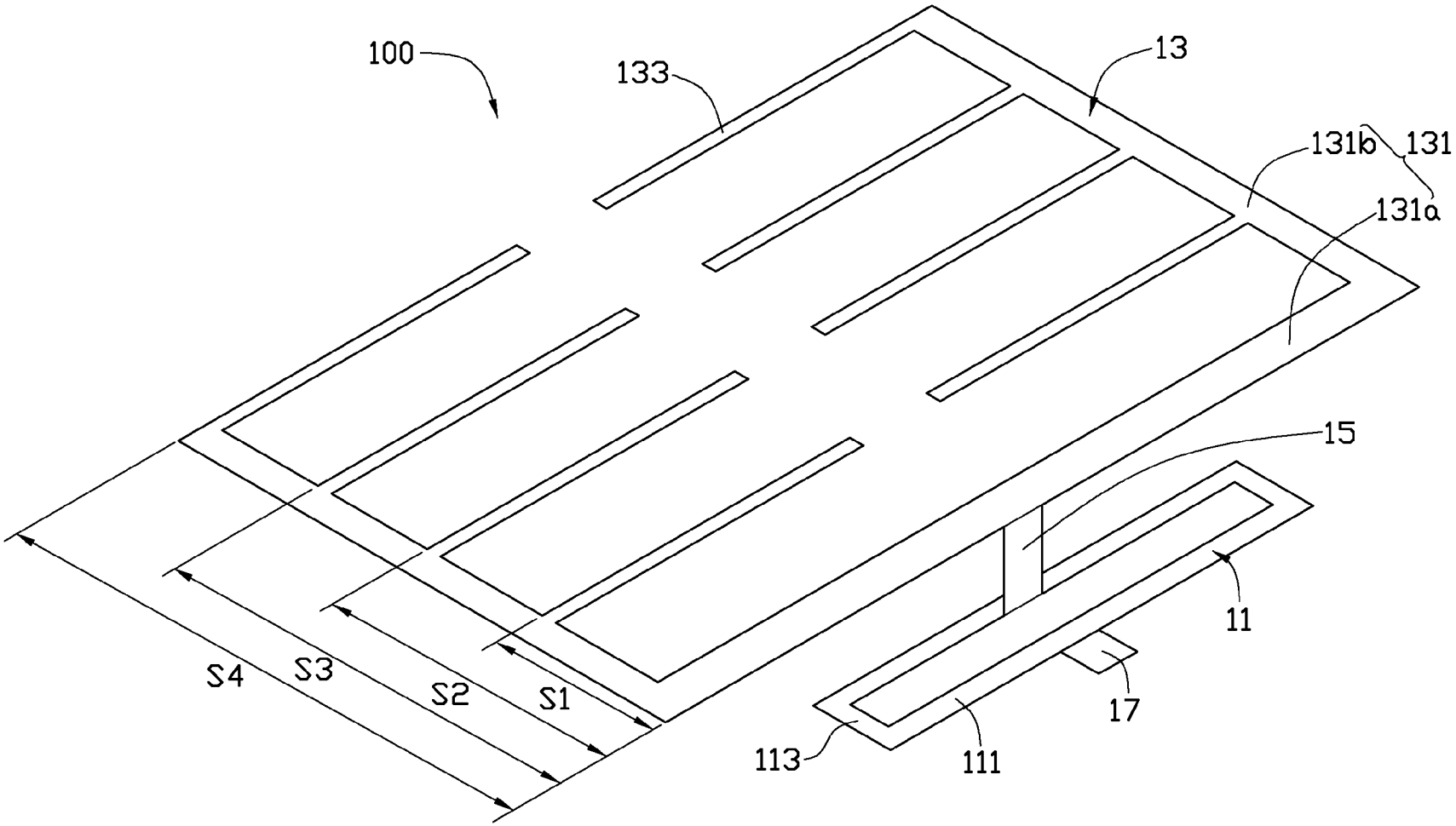
FIG. 2 is an enlarged view of the multiband antenna shown in FIG. 1.

FIG. 1 and FIG. 2 schematically show a multiband antenna 100 according to an exemplary embodiment, for use in portable electronic devices. The multiband antenna 100 can be installed in a portable electronic device and connected to a conventional circuit board 30 of the portable electronic device to receive/send wireless signals when the portable electronic device is used.

The multiband antenna 100 includes a first radio unit 11, a second radio unit 13, a connecting unit 15, and a feed unit 17. The first radio unit 11 and the second radio unit 13 are both planar sheets made of conductive materials, and are parallel to each other. The first radio unit 11 can be a rectangular frame, i.e., a closed loop. The first radio unit 11 includes two relatively longer sides 111 parallel to each other, and two relatively shorter sides 113 parallel to each other and perpendicularly connected between the two relatively longer sides 111.

The second radio unit 13 includes an approximately U-shaped main portion 131 and a plurality of inwardly directed arm portions 133. The main portion 131 includes a main section 131*a* and two extending sections 131*b*. The main section 131*a* and the extending sections 131*b* are longitudinal strips. The extending sections 131*b* are respectively perpendicularly connected to the ends of the main section 131*a*, and extend parallel to each other and towards a same side of the main section 131*a*. The arm portions 133 are all longitudinal sheets perpendicularly connected to the inner sides of the two extending sections 131*b* and parallel to the main section 131*a*. The arm portions 133 connected to a same extending section 131*b* are equidistant. Each arm portion 133 connected to one extending section 131*b* is aligned with another arm portion 133 connected to another extending section 131*b*, and each pair of arm portions 133 respectively connected to two extending sections 131*b* and aligned with each other are in a same distance away from the main section 131*a*. Thus, the second radio unit 13 has a symmetrical structure.

The connecting unit 15 is a rectangular sheet made of conductive materials, and should be perpendicular to the planes in which the first radio unit 11 and the second unit 13 are positioned. The connecting unit 15 has one end perpendicularly connected to the middle part of the inner side of a relatively longer side 111, and another end perpendicularly connected to the middle part of an outer side of the main section 131*a*. The feed member 17 can be a wire, a cable, a flexible flat cable (FFC), etc. The feed member 17 is connected to the middle part of an outer side of another relatively longer side 111 opposite to the connecting unit 15.

In assembly, the multiband antenna 100 is connected to the circuit board 30 by the feed member 17. The first radio unit 11 is coplanar with the circuit board 30 or parallel to the circuit board 30. The second radio unit 13 is spaced from, and parallel to the circuit board 30.

In use, the multiband antenna 100 can receive feed signals from the circuit board 30. When the feed signals are input into the multiband antenna 100 via the feed member 17, the multiband antenna 100 functions. Particularly, the first radio unit 11 functions as a balanced loop antenna. Changing the lengths of the relatively longer sides 111 and/or the relatively shorter sides 113 can regulate the impedance of the multiband antenna 100. The second radio unit 13 functions as a dipole antenna. Each pair of arm portions 133 cooperate with the main portion 131 to form a plurality of sub-radio units, e.g., S1, S2, S3, and S4, as shown in FIG. 2. The sub-radio units S1-S4 have different lengths between main section 131*a* and the sub-radio unit's respective pair of arm portions. Each sub-radio unit S1/S2/S3/S4 includes a pair of arm portions 133 aligned with each other, and all sub-radio units S1-S4 share the main portion 131. Particularly, each sub-radio unit S1/S2/S3/S4 includes the main section 131*a*, a pair of arm portions 133 aligned with each other, and portions of the extending sections 131*b* that connect the pair of arm portions 133 to the main section 131*a*. The sub-radio units S1-S4 can respectively serve as antennas to receive/send signals at different frequencies due to their different circuit lengths. Furthermore, during working, the sub-radio units S1-S4 can be coupled with each other to generate more resonating frequencies. Changing the number of the sub-radio units (i.e., changing the number of the arm portions 133) can also regulate the impedance of the multiband antenna 100. Therefore, both the first radio unit 11 and the second radio unit 13 can be used to regulate the impedance of the multiband antenna 10, and further regulate the working frequency bandwidth of the multiband antenna 100.

Figure 3:
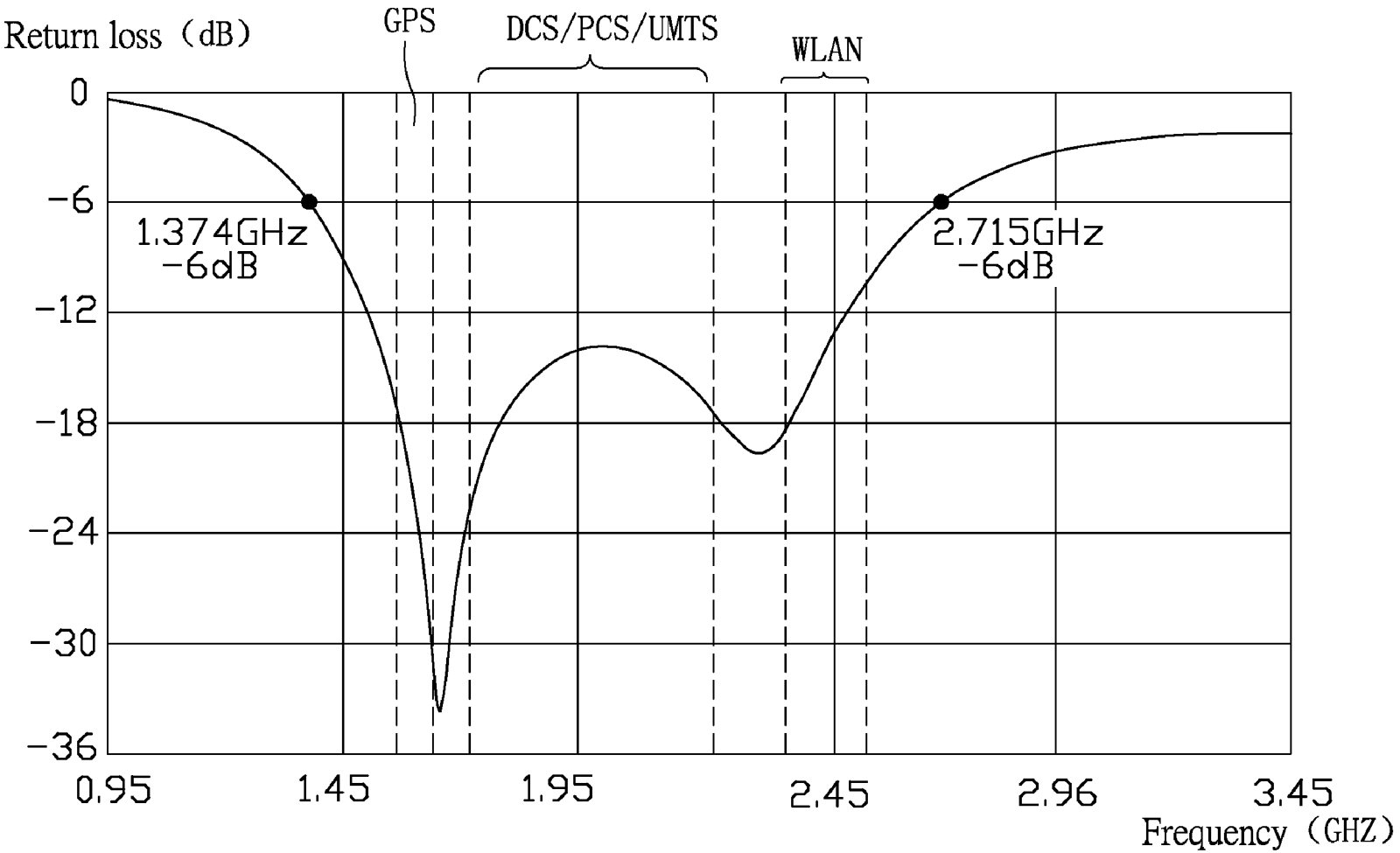
FIG. 3 is a diagram of return loss (RL) of the multiband antenna shown in FIG. 1
Figure 4:
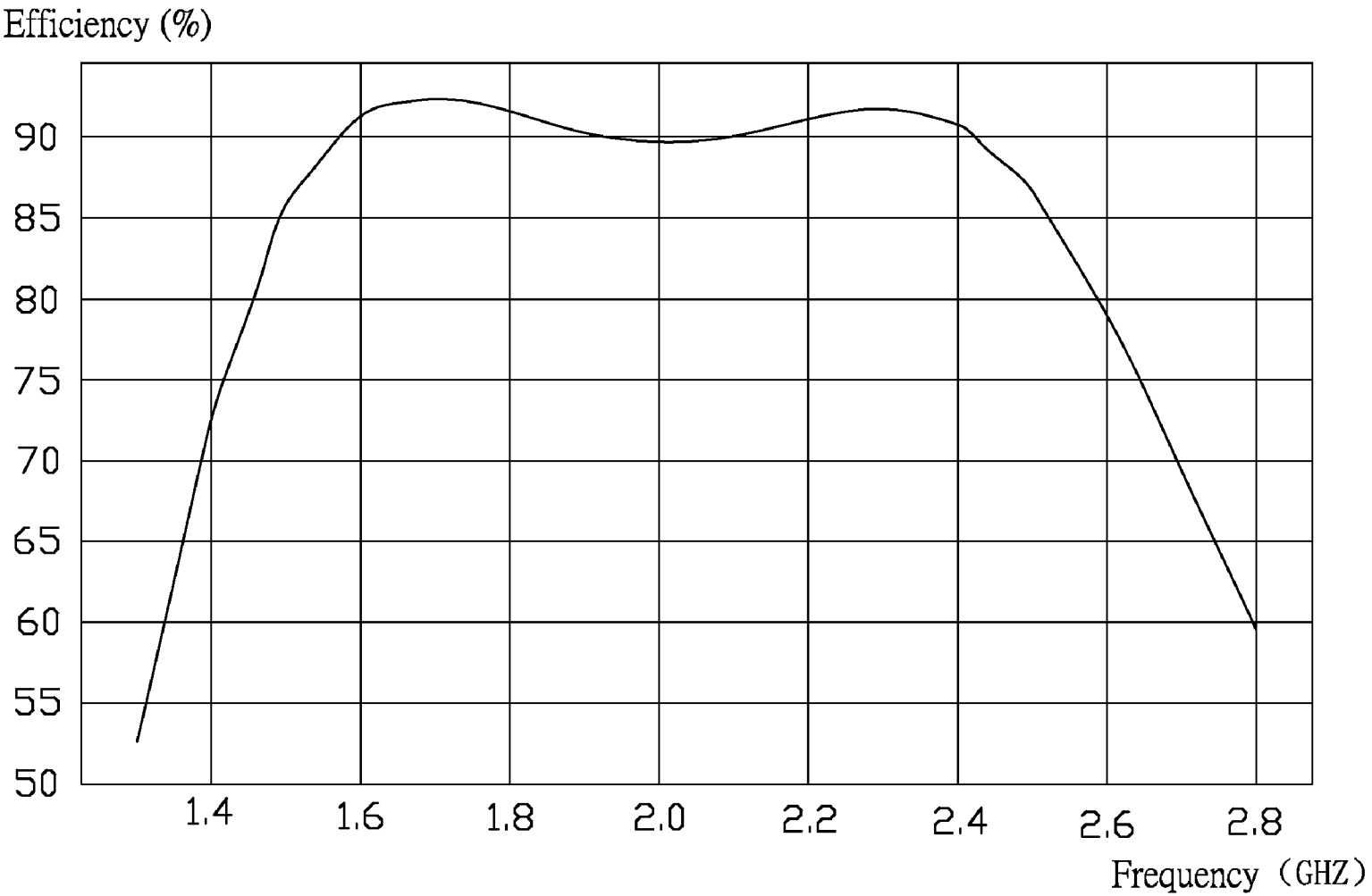
FIG. 4 is a diagram of radiation efficiency of the multiband antenna shown in FIG. 1.

Referring to FIG. 3 and FIG. 4, as determined in experiments, in a frequency band of about 1.4 GHz-2.7 GHz, the return loss (RL) of the multiband antenna 100 is less than −6 dB, and the radio efficiency of the multiband antenna 100 is not less than 75%. Furthermore, in a frequency of about 1.5 GHz-2.5 GHz, the efficiency of the multiband antenna 100 is not less than 85%. Therefore, the multiband antenna 100 can be used in a plurality of wireless communication systems having different working frequencies, such as GPS (Global Position System, about 1500 MHz), DCS1800 (Digital Communication System, about 1710-1880 MHz), PCS1900 (Personal Communication Services, about 1850-1990 MHz), UMTS (Universal Mobile Telecommunications System, about 2100 MHz), and WLAN (Wireless Local Area Network, about 2400 MHz), etc.

In the present exemplary disclosure, the outer dimension of the multiband antenna 100 is about 20 mm×13 mm×2 mm. Thus, the multiband antenna 100 can be easily installed in a limited space, such as the housing of the aforementioned portable electronic device, and easily connected to the circuit board 30.

The present multiband antenna 100 is small in size and has good communication quality for a plurality of frequency bands used in wireless communication, which can allow further reductions in sizes of portable electronic devices employing the multiband antenna 100. Note that the dimensions set forth herein are exemplary of the working frequencies also mentioned herein. Accordingly, the dimensions of the multiband antenna 100 are not limited to the dimensions set forth in this specification.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a first radio unit shaped as a closed loop; and a second radio unit connected to the first radio unit and symmetrically shaped; wherein the first radio unit functions as a balanced loop antenna and the second radio unit functions as a dipole antenna; and wherein the second radio unit includes a main portion and a plurality of arm portions connected to the main portion, the arm portions cooperating with the main portion to form a plurality of sub-radio units, and the sub-radio units coupled with each other to regulate the working frequency bandwidth of the multiband antenna.

2. The multiband antenna as claimed in claim 1, wherein the first radio unit and the second radio unit are both planar sheets and parallel to each other.

3. The multiband antenna as claimed in claim 2, wherein the first radio unit is a rectangular frame, the working frequency bandwidth of the multiband antenna being regulated by changing the lengths of the sides of the first radio unit.

4. The multiband antenna as claimed in claim 3, wherein the main portion includes a longitudinal main section and two longitudinal extending sections that are respectively perpendicularly connected to the ends of the main section and extend parallel to each other towards a same side of the main section.

5. The multiband as claimed in claim 4, wherein the arm portions are connected to the two extending sections.

6. The multiband antenna as claimed in claim 5, wherein the arm portions are longitudinal sheets perpendicularly connected to the inner sides of the two extending sections and parallel to the main section.

7. The multiband antenna as claimed in claim 6, wherein each arm portion connected to one extending section is aligned with another arm portion connected to another extending section, and each pair of arm portions respectively connected to two extending sections and aligned with each other are equidistant from the main section.

8. The multiband antenna as claimed in claim 6, wherein arm portions connected to a same extending section are equidistant.

9. The multiband antenna as claimed in claim 4, further comprising a connecting unit, which is a planar sheet having one end connected to the middle part of a side of the first radio unit and another end connected to the middle part of the main section.

10. The multiband antenna as claimed in claim 9, further comprising a feed unit connected to the middle part of another side of the first radio unit parallel to the side of the first radio unit connected to the connecting unit.

11. A multiband antenna, comprising:

a first radio unit, the first radio unit being a planar sheet and a rectangular frame, the working frequency bandwidth of the multiband antenna being regulated by changing the lengths of the sides of the first radio unit; and a second radio unit, the second radio unit being a planar sheet and including a main portion and a plurality of arm portions connected to the main portion; wherein the arm portions cooperate with the main portion to form a plurality of sub-radio units, and the sub-radio units are coupled with each other to regulate the working frequency bandwidth of the multiband antenna.

12. The multiband antenna as claimed in claim 11, wherein the first radio unit and the second radio unit are parallel to each other.

13. The multiband antenna as claimed in claim 11, wherein the main portion includes a longitudinal main section and two longitudinal extending sections that are respectively perpendicularly connected to two ends of the main section and extend parallel to each other towards a same side of the main section.

14. The multiband antenna as claimed in claim 13, wherein the arm portions are longitudinal sheets perpendicularly connected to the inner sides of the two extending sections and parallel to the main section.

15. The multiband antenna as claimed in claim 14, wherein each arm portion connected to one extending section is aligned with another arm portion connected to another extending section, and each pair of arm portions respectively connected to two extending sections and aligned with each other are equidistant from the main section.

16. The multiband antenna as claimed in claim 15, wherein arm portions connected to a same extending section are equidistant.

17. The multiband antenna as claimed in claim 11, further comprising a connecting unit, which is a planar sheet having one end connected to the middle part of a side of the first radio unit and another end connected to the middle part of the main section.

18. The multiband antenna as claimed in claim 17, further comprising a feed unit connected to the middle part of another side of the first radio unit parallel to the side of the first radio unit connected to the connecting unit.

* * * * *

UNITED STATES PATENT AND TRADEMARK OFFICE

CERTIFICATE OF CORRECTION

PATENT NO. : 8,330,666 B2
APPLICATION NO. : 12/693641
DATED : December 11, 2012
INVENTOR(S) : Tun-Yuan Tsou et al.

It is certified that error appears in the above-identified patent and that said Letters Patent is hereby corrected as shown below:

Please replace Item (73) regarding "Assignees" on the title page of the Patent with the following:

(73) Assignees: Chi Mei Communication Systems, Inc., Tu-Cheng, New Taipei (TW).

Signed and Sealed this
Twenty-sixth Day of November, 2013

Margaret A. Focarino

Margaret A. Focarino
*Commissioner for Patents of the United States Patent and Trademark Office*